United States Patent [19]

O'Sullivan et al.

[11] Patent Number: 4,543,891

[45] Date of Patent: Oct. 1, 1985

[54] APPARATUS AND PROCESS FOR HEAT TREATMENT

[75] Inventors: William T. O'Sullivan, Rolling Meadows, Ill.; Earl C. Pace, Valparaiso, Ind.

[73] Assignee: Westinghouse Electric Corp., Pittsburgh, Pa.

[21] Appl. No.: 599,403

[22] Filed: Apr. 12, 1984

[51] Int. Cl.[4] ..... F23N 5/00

[52] U.S. Cl. ..... 110/185; 62/228.4; 110/341; 236/49; 266/78; 266/256; 417/45; 432/36; 432/206

[58] Field of Search ..... 110/185, 186, 341; 432/36, 205, 206; 236/15 BF, 15 C, 49; 417/45, 280; 266/78, 256, 263; 364/477; 62/228.4

[56] References Cited

U.S. PATENT DOCUMENTS

| | | | |
|---|---|---|---|
| 1,706,753 | 3/1929 | Smoot . | |
| 2,160,968 | 6/1939 | Hagen | 236/15 C |
| 2,214,582 | 9/1940 | Hansen . | |
| 2,303,901 | 12/1942 | Baker . | |
| 2,789,808 | 4/1957 | Blackman | 236/15 BF |
| 3,448,969 | 6/1969 | Windsor . | |
| 3,499,297 | 3/1970 | Ruff et al. | 62/228.4 |
| 3,668,883 | 6/1972 | Ruff et al. | 62/228.4 |
| 3,817,451 | 6/1974 | Ramsey | 236/49 |
| 3,985,467 | 10/1976 | Lefferson | 417/45 |
| 4,080,110 | 3/1978 | Szymaszek | 417/280 |
| 4,141,539 | 2/1979 | Bornor | 266/78 |
| 4,145,161 | 3/1979 | Skinner | 417/45 |
| 4,257,746 | 3/1981 | Wells | 417/45 |
| 4,311,436 | 1/1982 | Hendriks | 417/45 |
| 4,330,238 | 5/1982 | Hoffman | 417/45 |
| 4,412,788 | 11/1983 | Shaw et al. | 417/280 |

*Primary Examiner*—Albert J. Makay
*Assistant Examiner*—Steven E. Warner
*Attorney, Agent, or Firm*—B. R. Studebaker

[57] ABSTRACT

Apparatus and process is disclosed for heat treating of material in a furnace comprising a fan driven by an electric motor, a load sensor which senses the motor load and a speed controller responsive to the load sensor signal for controlling the speed of the electric motor.

3 Claims, 6 Drawing Figures

APPARATUS AND PROCESS FOR HEAT TREATMENT

BACKGROUND OF THE INVENTION

1. Field of the Invention

This invention relates to heat treating furnaces of the type in which a gas is circulated within a chamber, and more particularly to apparatus and process for batch annealing of metal products.

2. Description of the Prior Art

During various metalworking processes, weaknesses are induced in metals which could result in unanticipated and unnecessary failure of the metal. In order to eliminate these weaknesses, the metal is annealed by being heated and subsequently cooled in a controlled manner so that the effect of the heat on the metal eliminates the weaknesses. In order to improve the annealing efficiency, it is desirable to improve the heat transfer in order to reduce the time involved with the process.

It is common practice, for instance, when annealing rolls of sheet metal, to stack the rolls one on top of the other, edgewise inside a furnace. A heat transfer gas, which may be air or any inert gas, is circulated by fan to improve the heat transfer during heat-up and cool-down of the metal.

The density of the gas in the chamber is not constant at all times, but instead changes in accordance with factors such as temperature and pressure. Because the density of the gas varies, difficulties are introduced to the process. For instance, it is difficult to precisely match the design of the fan and the capacity of the fan motor to the load presented by the gas. In prior furnaces, the fan motor either possessed too much capacity and thus was expensive both in first cost and in operating costs, or the motor repeatedly approached an overload condition and experienced a short service life.

One method used is disclosed in U.S. Pat. No. 4,141,539. Means are provided to sense the magnitude of current drawn by the motor. The load on the motor is modified by changing the density of the gas, generally by changing the pressure within the chamber. This device certainly protected the motor but did not do much in the way of improving the efficiency of the overall batch-annealing process. Further, it was only applicable in those cases in which gas was continuously admitted to and exhausted from the chamber during the batch-annealing process. Accordingly, it required a vacuum source and a pressure source which added to the cost of the furnace.

A further difficulty presented by the changing density of the gas in the chamber relates to the heat transfer characteristics of a gas as its density changes. Generally speaking, the heat transfer capability of a gas decreases as its density decreases. Thus, as the temperature of the gas in the chamber increases, the gas density decreases and the heat transfer capability also decreases. For the state of the art heat treatment furnace, the fan speed remains constant, however, the heat transfer capacity of gas moved by the fan decreases because the density has decreased.

What is needed is a process and apparatus for improving the efficiency of the heat treating process. What is further needed is a device which will compensate efficiently for the change in the density of the heat transfer gas related to the gas temperature.

SUMMARY OF THE INVENTION

Apparatus and process is disclosed for heat treating of material in a furnace comprising a fan driven by an electric motor, a load sensor which senses the motor load and a speed controller responsive to the load sensor signal for controlling the speed of the electric motor.

BRIEF DESCRIPTION OF THE DRAWINGS

The advantages, nature and additional features of the invention will become more apparent from the following description taken in connection with the accompanying drawings, in which.

DESCRIPTION OF THE PREFERRED EMBODIMENTS

Figure 1:
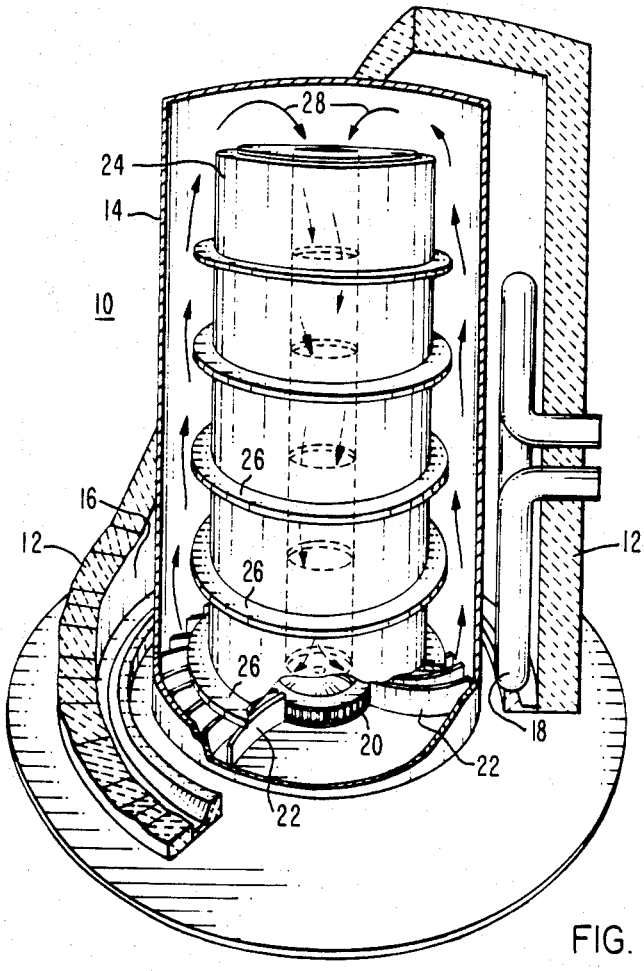
FIG. 1 is a partial sectional elevational view of a heat treating furnace in accordance with the invention.

Referring now to FIG. 1, there can be seen a heat treating furnace 10 which may be a batch-annealing furnace. There is shown a metallic outer shell 12, which may be lined with a material such as refractory ceramic. Contained within this shell 12 is a cover 14 within which the heat treating takes place. An annulus 16 is formed between the shell 12 and the cover 14. Within this annulus 16 is a source of heat 18 which may be a gas burner, a high temperature heat exchanger or similar apparatus.

Within the cover 14 are means for recirculation of gases within the cover 14, shown here in this embodiment as a fan 20. The fan 20 is seen disposed in the center at the bottom of the cover 14 but it may be disposed in any location which allows it to perform its gas recirculation function. Disposed around the fan 20 is a diffuser assembly 22 to improve the gas circulation. Resting on the diffuser assembly 22 is the charge 24 which is to be exposed to the heat treatment. This charge 24 may be coils of wire or rolls of cold rolled strip metal or any other suitable material. Typically, the charge 24 will be separated by separator plates 26 for ease in stacking and more efficient heat treatment. The cover 14 is generally filled with a heat transfer gas which may be either air or gases such as nitrogen or hydrogen for transfer of the heat to the charge 24. The gas flow path 28 illustrates the movement of the gas around the cover 14.

The cover 14 is generally a single piece which is lowered over the charge 24. It may rest on a sand seal (not shown) or on a flat surface. Usually, for various economic reasons, the cover 14 is not gas tight. Consequently, during heat-up and cooldown there may be significant gas leakage out of or into the cover 14.

Figure 2:
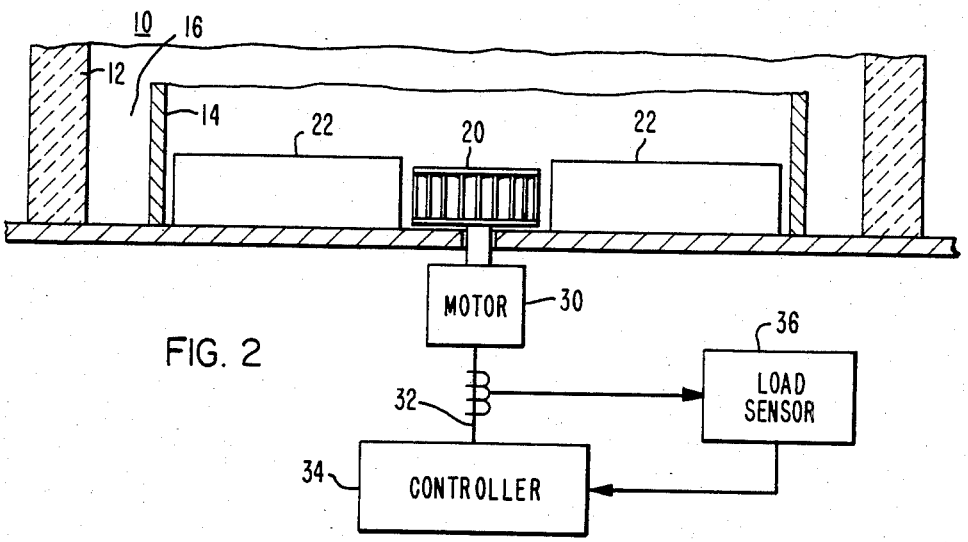
FIG. 2 is a sectional elevational view of a lower portion of a heat treating furnace in accordance with the invention.

Referring now to FIG. 2, there is shown an elevational sectional view of the lower portion of the annealing furnace 10. Connected to the fan 20 is a motor 30. Supplying power to the motor 30 is a load line 32 from a controller 34. A load sensor 36 senses the load on the motor 30 by determining the electrical power conveyed through the load line 32. The load sensor 36 generates a signal which is conveyed back to the controller 34.

The furnace 10 operates as follows: After a charge 24 is stacked on top of the diffuser assembly 22, the cover 14 is lowered over the charge 24, the shell 12 is lowered over the cover 14 and the heat transfer gas is introduced into the cover 14. The heat source 18 begins to generate heat within the annulus 16 and this heat is transferred to the cover 14. Power is supplied to the motor 30 and the fan 20 moves heat transfer gas along flow path 28 as shown. The flow path 28 generally begins with the fan 20, thence passing through the diffuser assembly 20 and upwardly along the cover 14 where heat is transferred to the gas from the heat source 18. On this upward flow, the gas heats that part of the charge 24 which faces outwardly. The gas further flows upwardly to the top of the cover 14 and downwardly through the center of the charge 24 to the fan 20. As it passes downwardly through the charge 24, the gas heats that part of the charge 24 which faces inwardly.

As the gas temperature increases, its pressure increases. Because the cover 14 is not gas tight, the gas pressure within the cover 14 will not rise very high before gas begins to leak from the cover 14. As the gas temperature continues to increase, gas continues to leak and the density of the gas begins to decrease. Because of this reduced gas density, the load on the fan 20 is reduced. The load sensor 36 senses this reduction in load and sends a signal to the controller 34. The controller 34 increases the speed of the motor 30, thereby increasing the speed of the fan 20. This speed change increases the volume of gas moved, which in turn improves the heat transfer rate of the process. The improved heat transfer rate results in a much shorter time to complete the annealing cycle, thereby improving the overall productivity of the batch process.

In like manner, after the annealing process is complete, but prior to cool-down, the heat source 18 ceases to generate heat. As the gas temperature begins to decrease, the gas pressure decreases, and since the cover 14 is not gas tight, air leaks in under the cover 14. This causes the gas density to increase during cool-down. As it increases, an increase in load will be applied to the motor 30. This increased load will then be detected by the load sensor 36 which will generate a signal to the controller 34. The controller 34 will cause the speed of the motor 30 to decrease, thereby reducing the load on the motor 30. Speed changes will then continue as temperature changes until a minimum speed is reached. At this point, the speed will remain constant until the process is completed.

Figure 3:
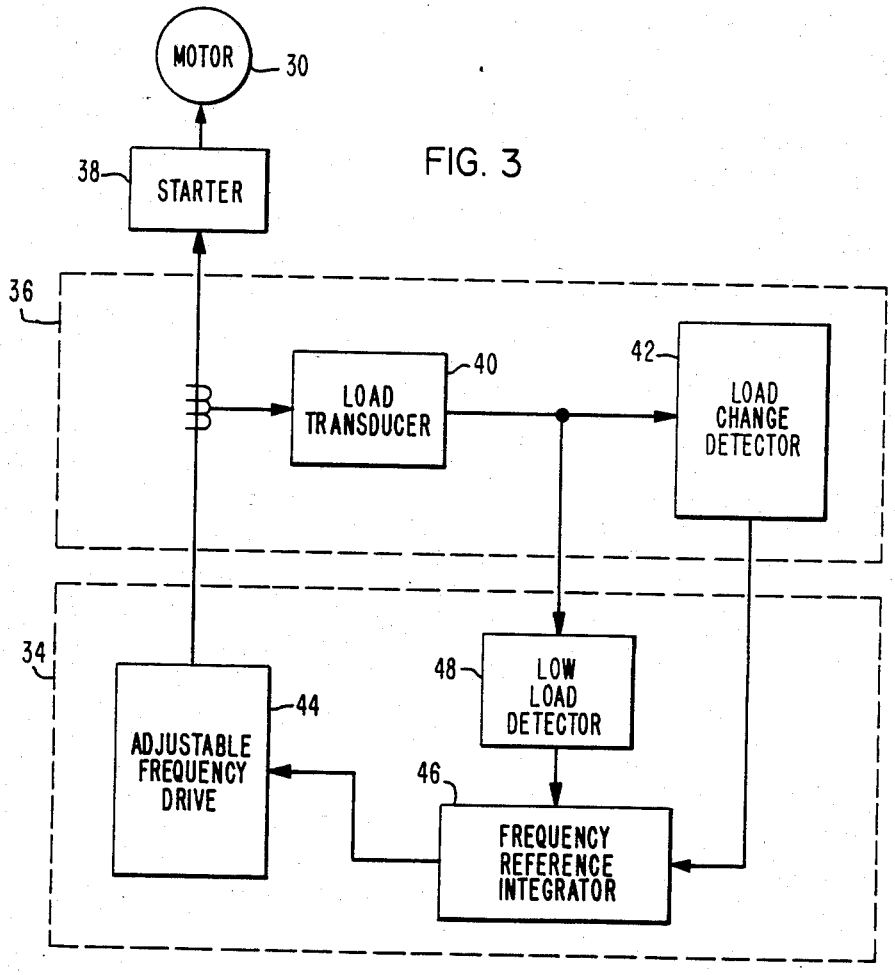
FIG. 3 is a functional circuit diagram of a fan control system in accordance with the invention.

Referring now to FIG. 3, there is shown a block diagram of circuitry which may be used to achieve the above result. Although this is the preferred mode, it is not the only method by which the above result may be obtained. There is shown in FIG. 3 a motor 30 electrically connected to a starter 38. Power to the starter 38 is transmitted from a controller 34 as in FIG. 2. A load sensor 36 is comprised of a load transducer 40 and a load change detector 42. The controller 34 is comprised of an adjustable frequency drive 44, a frequency reference integrator 46 and a low load detector 48. The load sensor 36 outputs a signal to indicate the direction of the load change as well as the length of time that the load is outside a load setpoint. The output from the load sensor 36 is fed into the controller 34, specifically into the frequency reference integrator 46, which has a capability of storing and changing a reference signal in proportion to the signal outputted from the load sensor 36. The output from the frequency reference integrator 46 is fed into the adjustable frequency drive 44 to control the output frequency of the variable or adjustable frequency drive 44. This, in turn, controls the speed of the motor 30 and therefore the fan 20. Any change in the speed of the fan 20 will affect the power load by the cube of the change. The load change is then detected and fed into the adjustable frequency drive to modify the fan 20 speed in the direction to maintain a preset load level.

This circuitry also includes a low load detector 48 to protect the motor 30 in case of failure of the load sensor 36. This low load detector 48 is adjusted to modify the signal output of the frequency reference integrator 46 to cause the adjustable frequency drive 44 to go to a preset minimum frequency position. This minimum frequency position will protect the motor 30 from overload.

Figure 4:
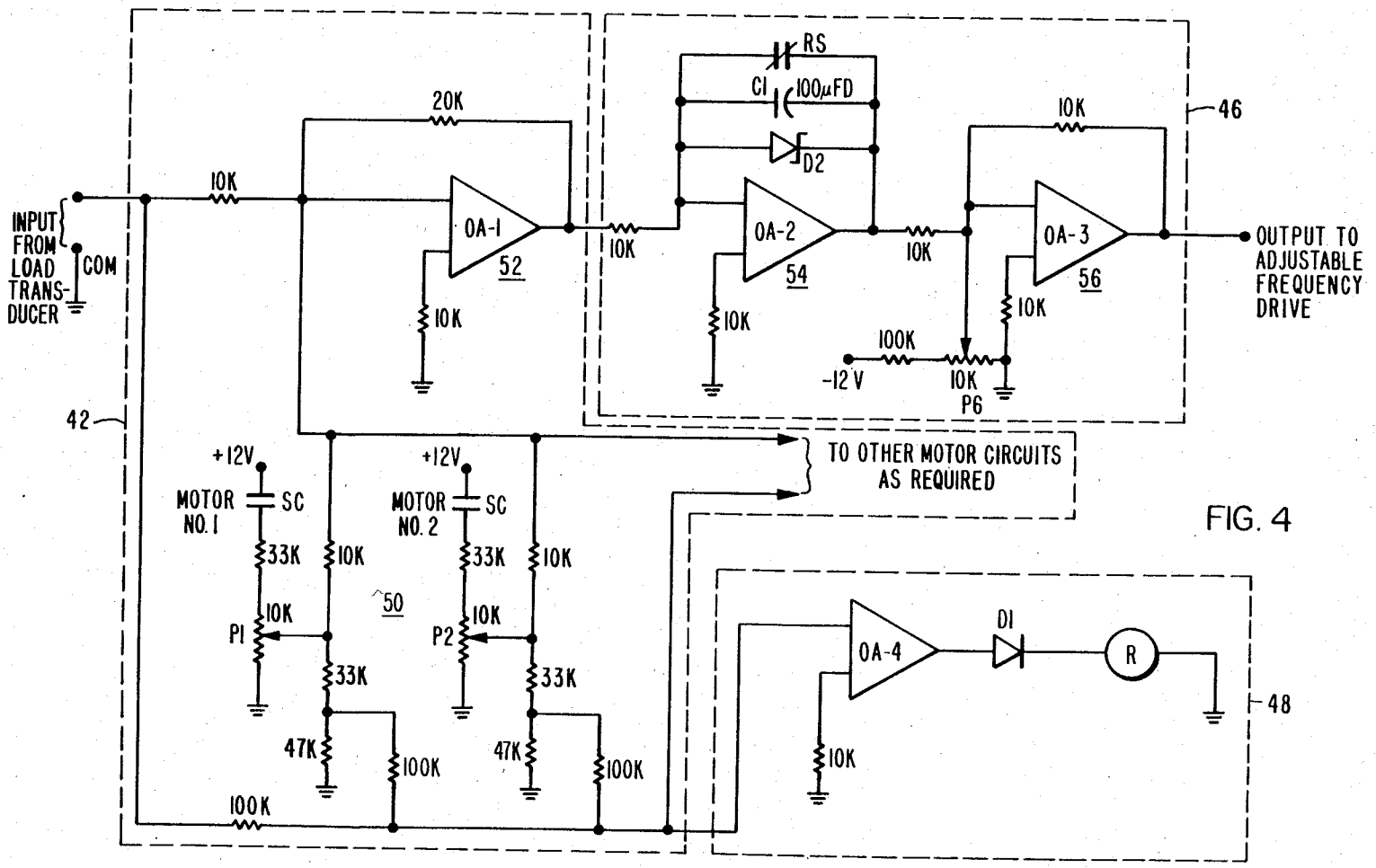
FIG. 4 is a circuit diagram of a fan control system in accordance with the invention.

FIG. 4 shows a more detailed embodiment of circuitry useful in implementing the invention. The load-change detector 42 is comprised primarily of a biasing network 50 and a load-change detector amplifier 52, including OP-AMP-1 (OA-1). The frequency reference integrator 46 is comprised of an integrator amplifier 54 and an integrator output amplifier 56. The integrator amplifier 54 is primarily comprised of OP-AMP OA-2, diode D-2, capacitor C-1, and relay switch RS. The integrator output amplifier 56 is primarily comprised of OP-AMP OA-3. The low load detector 48 is primarily comprised of OP-AMP OA-4, diode D-1, and relay R. The contacts in FIG. 4 are shown in their shutdown position.

In operation, the circuit in FIG. 4 takes a signal input from the load transducer 40 and provides an output signal to the adjustable frequency drive 44. Before the motor 30 is started for a normal annealing cycle, there is no input signal from the load transducer 40 and motor starter contacts SC within the biasing network 50 are open. As soon as the motor 30 is started, a starter contact SC will close and apply a bias signal as set by an adjustment potentiometer P-1 or P-2. This bias signal will be compared with the signal input from the load transducer 40. At this time, the load on the motor 30 is at its highest level, and this signal is larger than the bias signal. Relay R in the low load detector 48 will now cause relay switch RS in the integrator amp 54 to open to remove the short across OA-2 in the integrator amp 54. The load change detector amplifier 52 will now have a negative output and the integrator amp 54 will have a positive output. The output of the integrator amplifier 54 becomes the input to the integrator output amplifier 56 which has a bias input that is adjusted if required to provide an offset output voltage to the variable frequency drive 44.

At some point in the heating cycle, the load on the fan 20 will have been reduced to a value at which the input signal from the load transducer 40 will be less than the bias signal applied at OA-1. This will result in the output of OA-1 changing from negative to positive. The integrator amplifier 54 will now start to integrate to a maximum voltage limited by diode D-2. The integrator output amp 56 will output this signal and the variable frequency drive 44 will increase in frequency. This will increase the speed of the motor 30 which, in turn, will change the output from the load transducer 40.

The circuit in FIG. 4 will now operate to maintain the load on the motor 30 at a constant value. As the load decreases, the output of the integrator output amp 56 will increase to increase the frequency from the variable frequency drive 44; and when the load on the motor 30 increases, the output of the integrator output amplifier 56 will decrease to reduce the frequency of the variable frequency drive 44.

It can be seen that within the bias network 50, provision has been made for a first and second motor and additional motor circuits as required. The network can be designed to provide for multiple motors 30 within this circuit. In this case, the motor starter contacts SC will cause operation of the circuit with the correct number of motors 30 actually operating. In this light, the bias signal within the bias network 50 is set for each motor for the correct operation. If a motor 30 should trip off as, for example, during overload condition, the bias signal will be reduced and the system would continue to function properly. In this event, no attention would be required from an operator. It should also be noted that the bias on OA-4 within the low load detector 48 is a fixed percent of the bias on OA-1 (within the load change differential amplifier 52) to protect for a loss of signal from the load transducer or other motor problem. If the bias on OA-4 drops below a value set by the bias adjustment and fixed percent of that value, the relay R will drop out, causing relay switch RS to short the integrator amplifier 54 thus reducing the output of the frequency reference integrator 46 to zero.

An additional mode of operation in accordance with the invention utilizes a temperature feedback signal from within the furnace 10 to modify the output of the variable frequency drive 44 in such a manner as to reduce the motor 30 load in order to hold the maximum temperature of the charge 24 within a preset level.

This is accomplished by having a temperature signal fed into the integrator amp 54 in such a manner as to reduce the output of integrator amp 54 as the temperature increases above a preset bias level. The reduced output from the integrator amp 54 will then reduce the output from the integrator amp output amp 56 which in turn will cause the frequency of the variable frequency drive 44 to be reduced. As the temperature drops, the circuit reverts back to the basic load sensing/regulating only operation.

Figure 5:
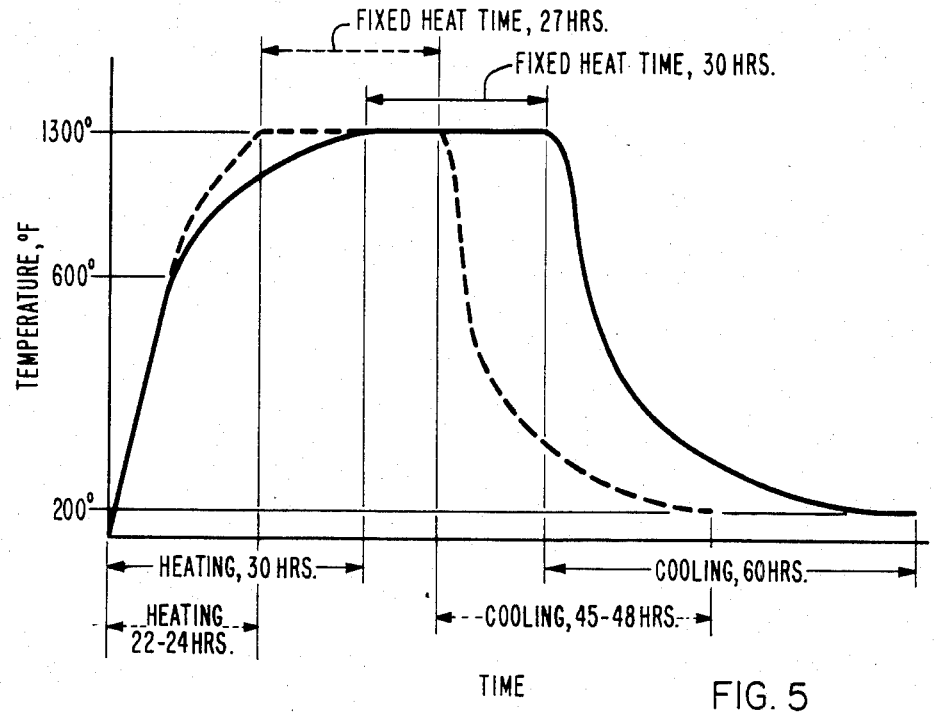
FIG. 5 is a graphical representation of a batch-annealing process showing a comparision for steel products of the state-of-the-art time/temperature curve and the time/temperature curve achievable in accordance with the invention.

FIG. 5 shows a graphical representation of the heat treating process on a temperature versus time basis. FIG. 5 is useful in understanding the advantages of the invention. The solid lines illustrate the annealing process of the state of the art, while the dotted lines represent the process in accordance with the invention. After the furnace 10 has been prepared for operation, the heat source 18 begins to generate heat and the fan 20 begins to circulate the gas in the flow path 28. The temperature of the charge 24 begins to rise at about 120° F. per hour. At between approximately 600° F. and 800° F., the gas density change affects the heat transfer and temperature increase rates of the charge 24. In the state of the art process, after a four-hour hold period (at a temperature between 600° F. and 800° F.), the temperature increase rate falls off to an average of 27° F. per hour between approximately 820° F. and 1170° F. This temperature rise of 350° F. takes place over approximately 13 hours. Above 1170° F. the temperature continues to increase to approximately 1300° F. The charge 24 then "soaks" for approximately 30 hours at a temperature of 1300° F. At the end of this time, the cooling cycle begins and the temperature of the charge decreases from 1300° F. to approximately 200° F. over 60 hours.

Looking now at the dotted lines, it can be seen that the annealing process has shifted to the left in time. This time savings has resulted in improvements in the heat-up and cool-down of the charge 24. In the process according to the invention, after achieving a temperature of approximately 600° F.–800° F., once again the gas density change has affected the heat transfer rate. In this case, however, as the density begins to decrease and the load on the fan 20 decreases, the control circuitry increases the speed of the fan 20 to increase the load. This increase in the fan 20 speed maintains a heat-up rate of the charge 24 which is greater than that of the state-of-the-art process. Since the heat transfer rate is approximately proportional to the gas circulation rate, a 40% increase in speed of the fan 20 should increase the temperature increase rate by a factor of 0.4. Accordingly, the 27° F. per hour change of the state-of-the-art process should be increased to approximately 37.8° F. per hour in the process in accordance with the invention. After achieving 1300° F., a soak is again required. However, because of the improved heat transfer, a soak time of 27 hours instead of 30 hours is acceptable. Upon completion of this 27 hour soak time, cool-down again commences and the temperature drops from approximately 1300° F. to approximately 200° F. over a time period of 45–48 hours.

It can be seen from FIG. 5 that the entire annealing process in accordance with the state of the art requires approximately 120 hours. In accordance with the invention, the same end result may be achieved over a period of between 94 and 99 hours. This is a considerable savings both in equipment time and energy cost.

Figure 6:
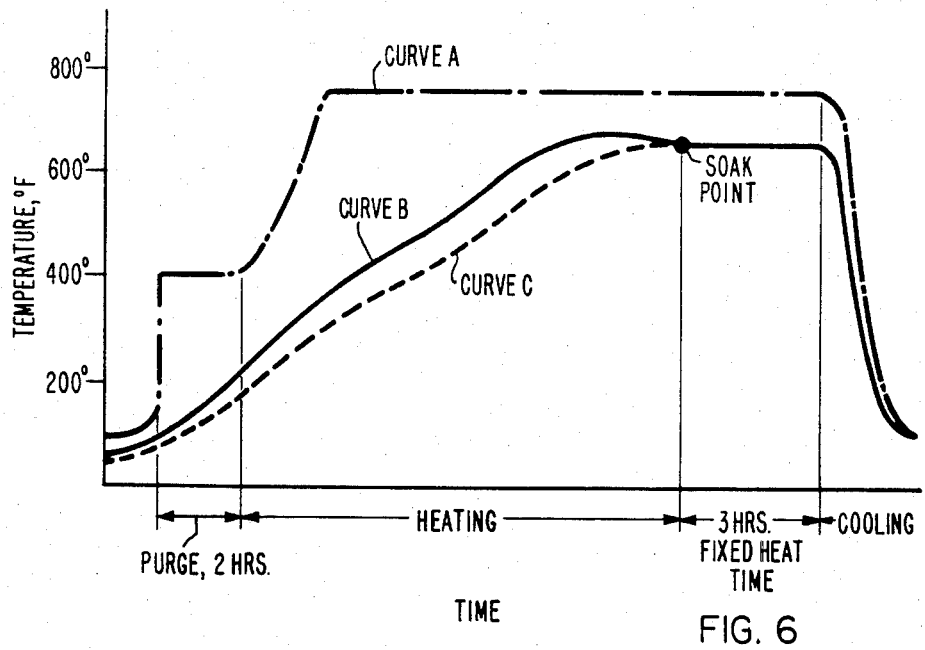
FIG. 6 is a graphical representation of a batch-annealing process showing a comparison for aluminum products of the state-of-the-art time/temperature curve and the time/temperature curve achievable in accordance with the invention.

A variation of this process may be used in batch annealing aluminum. FIG. 6 shows a curve setting out the batch-anneal process in accordance with the invention for aluminum. Three curves are shown. Curve A is the furnace curve. Curves B and C are temperature curves applicable to different parts of the charge. The furnace is heated up to a temperature of approximately 400° F. in an air atmosphere. At 400° F. there is a soak period during which the atmosphere within the furnace is purged with a carbon dioxide and nitrogen atmosphere. After this purge, heat-up continues until the coldest of the two charge temperatures reaches a temperature of about 675° F. to 750° F. The soak is then continued for three hours. At the end of three hours, the charge can be removed hot from the furnace; there is no requirement to control the cool-down rate.

Although the savings are not as apparent with respect to batch annealing of aluminum, it can be seen that improved circulation of the gas within the furnace may shorten the time required to bring the different areas of the charge up to the soak point. This time is currently between 10 and 19 hours.

What is claimed is:

1. Apparatus for batch-annealing a charge comprising:

(a) a batch-annealing furnace;

(b) a fan for circulating hot gas within said furnace;

(c) an electric motor on which a load is exerted by said fan;

(d) a load transducer for detecting an electrical load on said motor and capable of generating a load signal;

(e) a load change detector responsive to said load signal and capable of generating a load change signal;

(f) a frequency reference integrator responsive to said load change signal and capable of generating, storing and changing a reference signal responsive to said load change signal; and (g) an adjustable frequency drive responsive to said reference signal and capable of supplying a varying frequency alternating current power to said motor.

2. A process of batch-annealing a charge comprising the steps of:

(a) increasing the temperature of a heat transfer gas within a batch-annealing furnace during heat-up of said charge;

(b) circulating said heat transfer gas within said batch-annealing furnace with a fan driven by an electric motor;

(c) sensing a change in the electrical load on said motor in response to a change in density of said heat transfer gas and generating a signal related thereto;

(d) increasing the speed of said motor responsive to said signal to increase gas circulation within said furnace as the density of said gas decreases;

(e) decreasing the temperature of said heat transfer gas within said furnace during cool-down of said charge; and (f) decreasing the speed of said motor responsive to said signal to decrease gas circulation within said furnace as the density of said gas increases.

3. A method for significantly reducing the processing time in a batch-annealing furnace comprising the steps of:

(a) circulating a heat transfer gas within said furnace with a fan driven by an electric motor;

(b) sensing the electrical load on said motor and generating a signal related to said load;

(c) increasing the speed of said motor in response to a change in said signal to maintain a substantially constant load thereon as said gas is heated and the density thereof decreases; and (d) decreasing the speed of said motor in response to a change in said signal to maintain said load substantially constant as said gas is cooled and the density thereof increases.

* * * * *